US009121329B2

(12) United States Patent
Bogard et al.

(10) Patent No.: US 9,121,329 B2
(45) Date of Patent: Sep. 1, 2015

(54) TAILPIPE DIFFUSER

(75) Inventors: Joseph Trent Bogard, Seymour, IN (US); Thomas J. Rohm, Columbus, IN (US)

(73) Assignee: Faurecia Emissions Control Technologies, USA, LLC, Columbus, IN (US)

( * ) Notice: Subject to any disclaimer, the term of this patent is extended or adjusted under 35 U.S.C. 154(b) by 134 days.

(21) Appl. No.: 13/454,123

(22) Filed: Apr. 24, 2012

(65) Prior Publication Data

US 2013/0277143 A1 Oct. 24, 2013

(51) Int. Cl.
*F01N 13/08* (2010.01)

(52) U.S. Cl.
CPC ..... *F01N 13/082* (2013.01)

(58) Field of Classification Search
CPC ..... F01N 13/082
USPC ..... 60/317, 324; 181/220, 227, 239, 228, 181/258, 259, 268, 238; D12/194
See application file for complete search history.

(56) References Cited

U.S. PATENT DOCUMENTS

| | | | | | |
|---|---|---|---|---|---|
| 1,067,200 | A | * | 7/1913 | Sclosberg | 181/268 |
| 1,128,306 | A | * | 2/1915 | Goezler | 181/267 |
| 1,497,553 | A | * | 6/1924 | Dickman | 181/239 |
| 1,561,859 | A | * | 11/1925 | Kemble | 181/239 |
| 1,709,333 | A | * | 4/1929 | Webb, Sr. | 181/259 |
| 1,729,018 | A | * | 9/1929 | Siders | 181/269 |
| 1,745,492 | A | * | 2/1930 | Kelch et al. | 165/51 |
| D101,840 | S | * | 11/1936 | Koch | D12/194 |
| 2,122,086 | A | * | 6/1938 | Chase | 181/269 |
| 2,570,728 | A | * | 10/1951 | Storey | 181/243 |
| 2,629,455 | A | * | 2/1953 | Cushman | 181/262 |
| 2,654,437 | A | * | 10/1953 | Woods | 181/239 |
| 2,706,014 | A | * | 4/1955 | Carroll | 181/239 |
| 2,933,148 | A | * | 4/1960 | Hendry | 181/246 |
| 3,009,530 | A | * | 11/1961 | Cocklin | 181/265 |
| 3,119,459 | A | * | 1/1964 | Ludlow et al. | 181/227 |
| 3,195,678 | A | * | 7/1965 | Morgan et al. | 181/221 |
| D220,165 | S | * | 3/1971 | Trainor | D12/194 |
| 3,576,232 | A | | 4/1971 | Lebert | |
| 3,670,845 | A | * | 6/1972 | Betts | 181/269 |
| 4,696,368 | A | * | 9/1987 | Hummel et al. | 180/309 |
| 5,371,331 | A | * | 12/1994 | Wall | 181/227 |

(Continued)

FOREIGN PATENT DOCUMENTS

| | | |
|---|---|---|
| DE | 112007000180 T5 | 12/2008 |
| DE | 102010045551 | 5/2012 |

(Continued)

OTHER PUBLICATIONS

German Search Report for German Patent Application No. 10 2013 103 638.4 completed on Dec. 9, 2013.

*Primary Examiner* — Jeremy Luks
(74) *Attorney, Agent, or Firm* — Carlson, Gaskey & Olds, PC

(57) ABSTRACT

A diffuser for a vehicle exhaust system includes a body defined by a tubular portion comprising an outer peripheral wall extending about a central axis and at least one surface that extends at an angle relative to the central axis. A tailpipe connection interface is formed at one end of the tubular portion. In one example, the surface extends at an oblique angle relative to the central axis. In another example, a first plurality of holes is formed within the outer peripheral wall and a second plurality of holes is formed within the surface.

28 Claims, 5 Drawing Sheets

(56) References Cited

U.S. PATENT DOCUMENTS

| | | | | |
|---|---|---|---|---|
| D467,210 | S * | 12/2002 | Yu | D12/194 |
| 6,564,901 | B2 * | 5/2003 | Woods | 181/235 |
| 7,552,797 | B2 * | 6/2009 | Luttig | 181/250 |
| 7,757,481 | B2 * | 7/2010 | Ryan et al. | 60/298 |
| 7,971,432 | B2 * | 7/2011 | Troxler | 60/324 |
| 8,006,489 | B2 | 8/2011 | Dickinson et al. | |
| 8,286,421 | B2 * | 10/2012 | Dickinson et al. | 60/317 |
| 2003/0223222 | A1 * | 12/2003 | Yu | 362/96 |
| 2009/0145119 | A1 | 6/2009 | Farrell et al. | |
| 2010/0043412 | A1 * | 2/2010 | Dickinson et al. | 60/317 |
| 2010/0083647 | A1 * | 4/2010 | Dickinson et al. | 60/324 |
| 2010/0212767 | A1 * | 8/2010 | Derry et al. | 138/108 |
| 2011/0023473 | A1 * | 2/2011 | Ferderer et al. | 60/324 |
| 2012/0017566 | A1 * | 1/2012 | Krajewski et al. | 60/273 |

FOREIGN PATENT DOCUMENTS

| | | | |
|---|---|---|---|
| FR | 2897830 | A1 | 8/2007 |
| JP | S54127015 | | 9/1979 |
| JP | S54167215 | | 11/1979 |
| WO | 2011024231 | A1 | 3/2011 |

* cited by examiner

TAILPIPE DIFFUSER

TECHNICAL FIELD

The subject invention generally relates to a diffuser for a vehicle exhaust system.

BACKGROUND OF THE INVENTION

Vehicle exhaust systems are comprised of various components that direct exhaust gas generated by an internal combustion engine to the external environment. The exhaust system includes components that remove contaminants from the exhaust gas and components that control the noise produced by vehicle during operation. One example of a noise reduction component is a muffler. Exhaust gas passes through the muffler and exits to the external environment through a tailpipe. Flow noise is generated as exhaust gas exits the tailpipe.

Previous proposed solutions for addressing flow noise have included using a larger tailpipe or using a perforated inner tube or high frequency tuner within the muffler. These prior solutions were disadvantageous from a packaging perspective and presented tuning challenges.

Another proposed solution is to mount a diffuser to the tailpipe. The diffuser is mounted to an end of the tailpipe and is configured to diffuse and dilute exhaust gas exiting the vehicle. One adverse effect of using a diffuser is an increase in exhaust system backpressure, which is undesirable.

SUMMARY OF THE INVENTION

A diffuser for a vehicle exhaust system includes a body defined by a tubular portion comprising an outer peripheral wall extending about a central axis and at least one surface that extends at an angle relative to the central axis. A tailpipe connection interface is formed at one end of the tubular portion.

In one example, the at least one surface extends at an oblique angle relative to the central axis.

In another example, the at least one surface comprises at least a first surface extending at a first angle relative to the central axis and a second surface extending at a second angle relative to the central axis.

In one example, the first and second angles are oblique angles relative to the central axis.

In one example, a first plurality of holes is formed within the outer peripheral wall and a second plurality of holes is formed within the at least one surface.

In one example, the first plurality of holes is defined by a first diameter and the second plurality of holes is defined by a second diameter that is different than the first diameter.

In one example, the first diameter is greater than the second diameter.

In one example, the body is defined by an outer surface area and the first and second pluralities of holes define a total open area portion of the outer surface area that is at least 50%.

In one example, the total open area portion is within a range of 54% to 80% of the outer surface area.

These and other features of the present invention can be best understood from the following specification and drawings, the following of which is a brief description.

DETAILED DESCRIPTION

Figure 1:
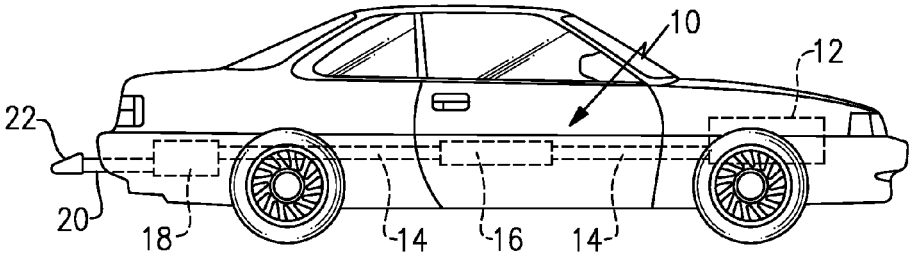
FIG. 1 is a schematic representation of a vehicle exhaust system with a tailpipe diffuser.

A vehicle exhaust system 10 directs exhaust gas generated by an internal combustion engine 12 to the external environment. The exhaust system 10 includes a series of pipes 14 and one or more components 16 that remove contaminants from the exhaust gas. The exhaust system also includes components that control the noise produced by vehicle during operation. One example of a noise reduction component is a muffler 18. Exhaust gas passes through the muffler 18 and exits to the external environment through a tailpipe 20. Flow noise is generated as exhaust gas exits the tailpipe 20.

In order to reduce the flow noise, a diffuser 22 is mounted to the tailpipe 20. The diffuser 22 is mounted to an end of the tailpipe 20 and is configured to diffuse and dilute exhaust gas exiting the vehicle.

Figure 2:
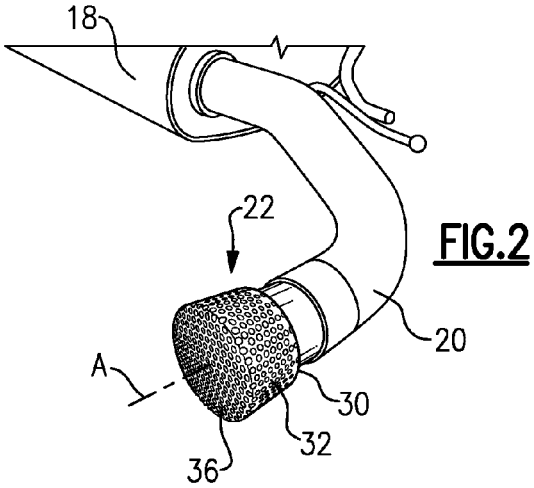
FIG. 2 is a perspective view of one example of a diffuser installed on a tailpipe.
Figure 3:
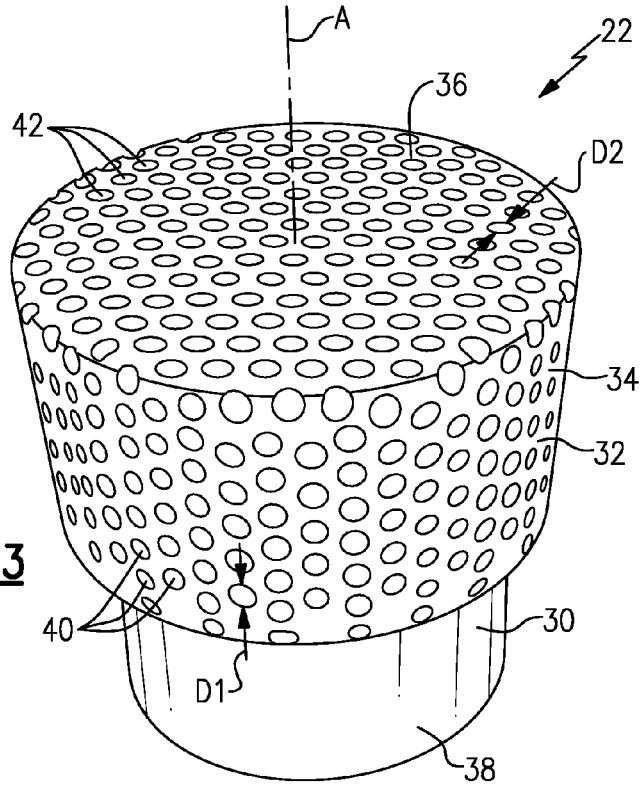
FIG. 3 is a magnified view of the diffuser of FIG. 2.

In one example shown in FIGS. 2-3, the diffuser 22 comprises a body 30 including a tubular portion 32 defined by an outer peripheral wall 34 extending about a central axis A and at least one surface 36 that extends at an angle relative to the central axis A. A tailpipe connection interface 38 is formed at one end of the tubular portion 32. A first plurality of holes 40 is formed within the outer peripheral wall 34 and a second plurality of holes 42 is formed within the angled surface 36.

In one example, the tubular portion 32 is configured to be attached to a tailpipe having an overall diameter of 2.5 inches or less. In one example, the tailpipe connection interface 38 of the diffuser 22 comprises weld connection to the tailpipe 20; however, other methods can be used to attach the diffuser 22 to the tailpipe 20.

Any type of metallic material can be used to form the diffuser. A material with good corrosive properties is preferred.

In this example, the body 30 and angled surface 36 cooperate to define a cup-shaped diffuser. The angled surface 36 is generally orientated at a perpendicular angle relative to the central axis A and forms an end face of the diffuser 22. The outer peripheral wall portion extends axially from an outer periphery of the surface 36 in a direction common with the central axis A to form the tubular portion 32.

As shown in FIG. 3, the body 30 is defined by an outer surface area and the first 40 and second 42 pluralities of holes define a total open area portion of the outer surface area. In one example, the total open area portion is within a range of 50%-80% of the outer surface area. Thus, in one example, the total open area is at least 50%; however, a preferred range is 54% to 80%. The percentage of open area is critical to limit backpressure issues when dealing with flow noise.

In the example shown in FIGS. 2-3, the total open area is approximately 54% for a pipe having a 2 inch diameter. The first plurality of holes 40 are defined by a first diameter D1 and the second plurality of holes 42 are defined by a second diameter D2. In the example of FIGS. 2-3, the first D1 and second D2 diameters are approximately equal to each other.

Figure 4:
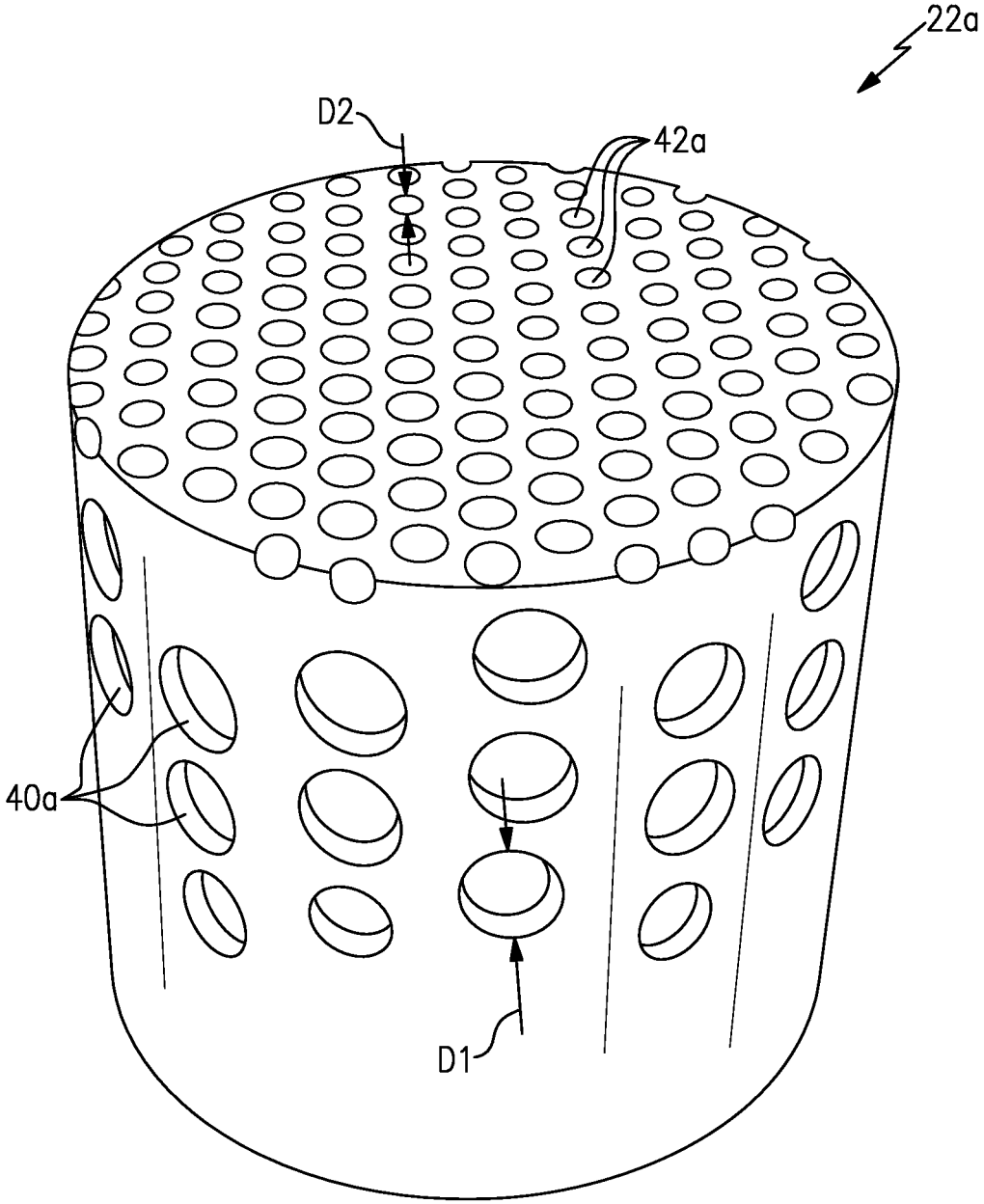
FIG. 4 is a perspective view of another example of a diffuser.

FIG. 4 shows another diffuser 22*a* that is similar to that of FIG. 3. However, in this example, the first diameter D1 for the first plurality of holes 40*a* is greater than the second diameter D2 for the second plurality of holes 42*a*. Have two sets of holes with two different diameters further facilitates reducing back pressure.

As shown in FIG. 4, a first open area is provided by the first plurality of holes 40 and a second open area is provided by the second plurality of holes 42. The first open area comprises approximately 40% of the total open area and the second open comprises approximately 60% of the total open area. This proportional area configuration further facilitates the reduction of back pressure and flow noise attenuation.

Figure 5:
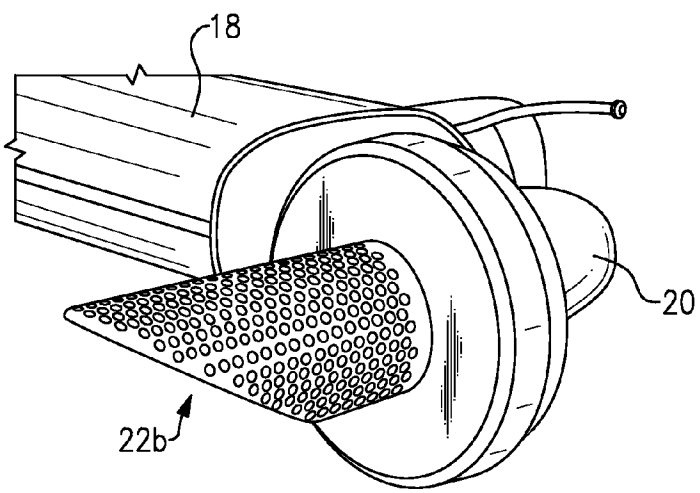
FIG. 5 is a perspective view of another example of a diffuser installed on a tailpipe.
Figure 6:
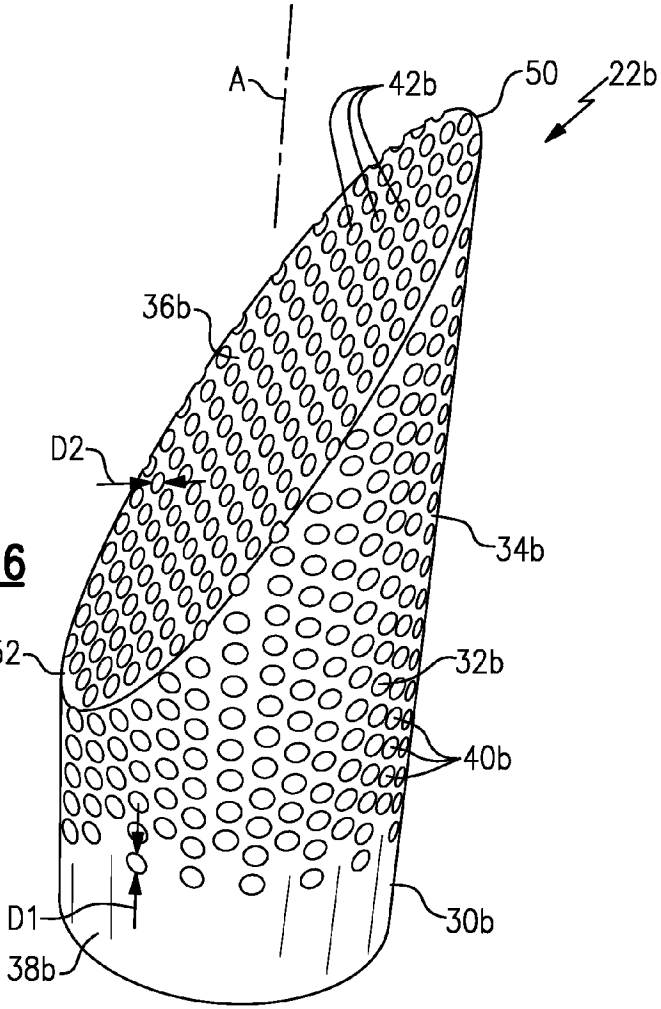
FIG. 6 is a magnified side view of the diffuser of FIG. 5.

FIGS. 5-6 show another example of a diffuser 22*b*. In this example, the diffuser 22*b* comprises a body 30*b* including a tubular portion 32*b* defined by an outer peripheral wall 34*b* extending about a central axis A and at least one surface 36*b* that extends at an angle relative to the central axis A. A tailpipe connection interface 38*b* is formed at one end of the tubular portion 32*b*. A first plurality of holes 40*b* is formed within the outer peripheral wall 34*b* and a second plurality of holes 42*b* is formed within the angled surface 36*b*.

In this example, the angled surface 36*b* is orientated at an oblique angle relative to the central axis A.

The angled surface 36*b* provides a tapered end face of the diffuser 22*b* with a distal edge 50 of the surface 36*b* being spaced a greater axial distance from the tailpipe connection interface 38*b* than an opposite edge 52 of the surface 36*b*. The outer peripheral wall 34*b* extends in an axial direction from an outer peripheral edge of the tapered end face to the tailpipe connection interface 38*b*. In the example of FIGS. 5-6 the surface tapers from edge 52 to edge 50 in a generally constant amount such that the surface 36*b* comprises a generally flat surface.

In this example the diameters D1, D2 of the holes 40*b*, 42*b* are generally equal to each other. However, the holes 40*b*, 42*b* could also have diameters that are different from each other. Preferably, the second plurality of holes 42*b* would have a larger diameter D2 than the diameter D1 of the first plurality of holes 40*b* such as in the example of FIG. 4.

Figure 7A:
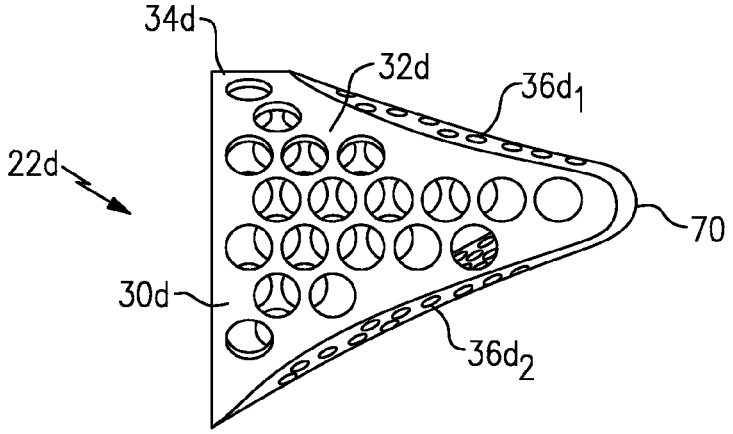
FIG. 7A is one side view of another example of a diffuser.
Figure 7B:
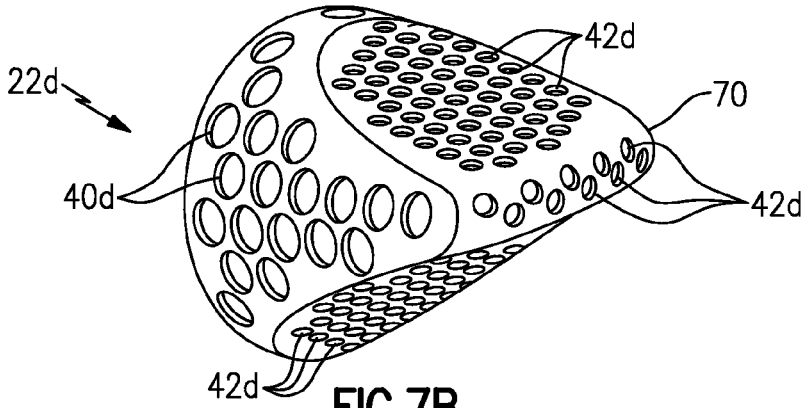
FIG. 7B is a rear perspective view of the diffuser of FIG. 7A.
Figure 7C:
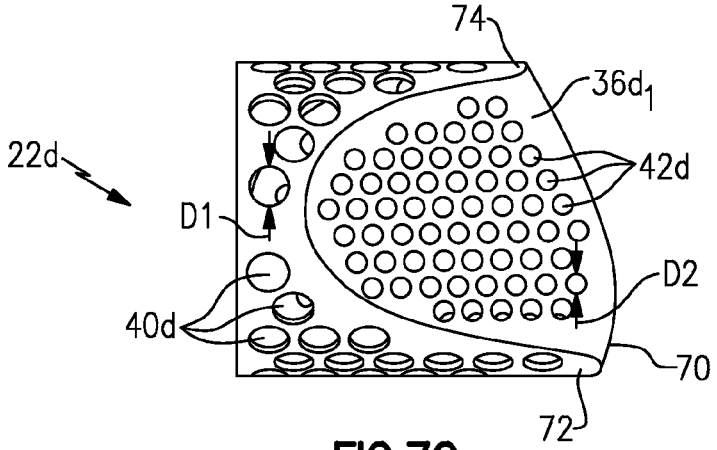
FIG. 7C is a top view of the diffuser of FIG. 7A.

FIGS. 7A-7C show another example of a diffuser 22*d*. The diffuser 22*d* comprises a body 30*d* including a tubular portion 32*d* defined by an outer peripheral wall 34*d* extending about a central axis A and at least a first surface 36*d*1 that extends at an angle relative to the central axis A and a second surface 36*d*2 that extends at an angle relative to the central axis A. A tailpipe connection interface 38*d* is formed at one end of the tubular portion 32*d*. A first plurality of holes 40*d* is formed within the outer peripheral wall 34*d* of the tubular portion 32*d* and a second plurality of holes 42*d* is formed within the angled surfaces 36*d*1, 36*d*2.

In the example shown, the first holes 40*d* are defined by a diameter D1 that is greater than a diameter D2 of the second holes 42*d*.

Further, as best shown in FIG. 7A, there is a curved transition surface 70 extending between the first 36*d*1 and second 36*d*2 surfaces. This curved transition surface 70 also includes holes 42*d* (see FIG. 7B). Further, surfaces 36*d*1, 36*d*2 extend to a further axial extent on one side 72 of the tubular portion 32*d* than an opposite side 74 of the tubular portion as shown in FIG. 7C. Thus, the curved transition surface 70 is curved in more than one direction.

Figure 8A:
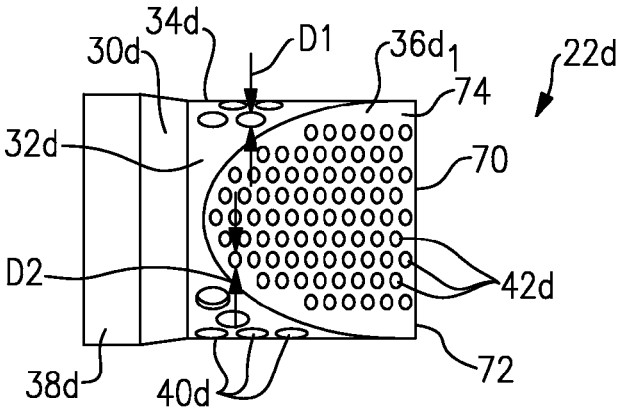
FIG. 8A is a top view of another example of a diffuser.
Figure 8B:
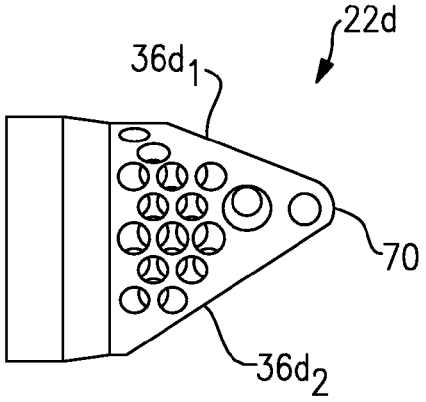
FIG. 8B is a side view of the diffuser of FIG. 10A
Figure 8C:
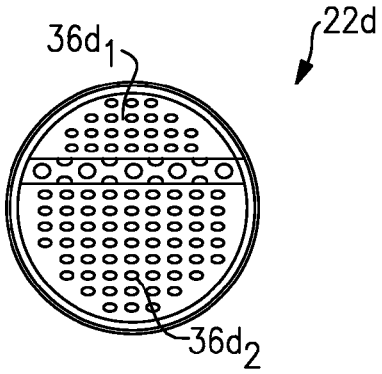
FIG. 8C is an end view of the diffuser of FIG. 10A.

FIGS. 8A-8C shown an example that is similar to that of FIGS. 7A-7C; however, in this configuration the curved transition surface 70 extends generally to the same axial extent on both sides 72, 74 of the tubular portion (see FIG. 8A).

In each of the embodiments disclosed above, the tailpipe diffuser is used to reduce flow noise. As discussed above, the percentage of open surface area in the diffuser is critical to eliminating back pressure issues that are created in the attempt to address the flow noise. Generally, an open area of 54% provides an ideal configuration for reducing noise and back pressure; however, a range of open area could comprise 54%-80%. Further, the combination of two different hole sizes for the tubular portion and angled surfaces also assists in reducing back pressure. Also, having at least one obliquely angled surface further enhances the reduction of noise and back pressure compared to the configuration of FIGS. 2-3.

The combination of the 60/40 open area ratio with the overall open area of 54% of the total surface area greater than tailpipe connection interface diameter provides the most effective noise and back pressure reduction. This combination effectively reduces flow created by high velocity flow through a small diameter pipe to obtain a more subjectively pleasing sound without significantly increasing back pressure.

The shape of the diffuser is uniquely configured to create a flow distribution that is a minimal to back pressure increase. The angled surface creates more surface area for the 60 (smaller hole surface)/40 (larger hole surface) split where the smaller sized holes are on the angled surfaces and the larger holes are on the tubular portion. The angle of the surfaces also disperses the air flow more evenly through the holes. The mismatch between the holes sizes compliment diffusing the high velocity flow in small diameter tailpipes while at the same time limiting restriction. Experimental testing showed that if a 54% open area larger than the pipe diameter is maintained, balancing the 60/40 split between the different hole sizes results in a minimal increase to restriction. Further, tailpipe acoustic content is also reduced with this diffuser tip configuration.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A diffuser for a vehicle exhaust system comprising:

a body including a tubular portion defined by an outer peripheral wall extending about a central axis and at least one surface that extends at an angle relative to the central axis, and wherein the body extends from a first end to a second end;

a tailpipe connection interface formed at the first end of the body that is adapted for attachment to a tailpipe through which exhaust gas exits to external atmosphere, and with the at least one surface extending outwardly and away from the tailpipe to enclose the second end of the body, and wherein the at least one surface comprises a distal end of the diffuser and wherein the tailpipe terminates at the at least one surface;

a first plurality of holes formed within the outer peripheral wall; and a second plurality of holes formed within the at least one surface.

2. The diffuser according to claim 1 wherein the body is defined by an outer surface area and wherein the first and second pluralities of holes define a total open area portion of the outer surface area that is at least 50%.

3. The diffuser according to claim 2 wherein the open area portion is at least 54%.

4. The diffuser according to claim 3 wherein the open area portion is within a range of 54% to 80%.

5. The diffuser according to claim 2 wherein the first plurality of holes are defined by a first hole diameter and the second plurality of holes are defined by a second diameter that is different than the first diameter.

6. The diffuser according to claim 5 wherein the first diameter is greater than the second diameter.

7. The diffuser according to claim 1 wherein the angle of the at least one surface comprises a perpendicular angle such that the surface comprises a generally flat end face with the outer peripheral wall extending in an axial direction from an outer peripheral edge of the end face to the tailpipe connection interface.

8. The diffuser according to claim 1 wherein the angle of the at least one surface comprises an oblique angle such that the surface comprises a tapered end face that tapers outwardly away from and external to the tailpipe, and with the outer peripheral wall extending in an axial direction from an outer peripheral edge of the tapered end face to the tailpipe connection interface.

9. The diffuser according to claim 1 wherein the at least one surface comprises at least a first surface extending at a first angle relative to the central axis and a second surface extending at a second angle relative to the central axis to form respective first and second tapered faces that taper outwardly away from and external to the tailpipe.

10. The diffuser according to claim 9 wherein the first and second angles comprise oblique angles.

11. The diffuser according to claim 10 wherein the first surface is on one side of the body and the second surface is on an opposite side of the body.

12. The diffuser according to claim 11 wherein the second plurality of holes are formed within the first and second surfaces and are defined by a first hole diameter and the first plurality of holes are defined by a second diameter that is different than the first diameter.

13. The diffuser according to claim 12 wherein the body is defined by an outer surface area and wherein the first and second pluralities of holes define a total open area portion of the outer surface area that is within a range of 54% to 80%.

14. The diffuser according to claim 1 wherein exhaust gas exits directly to the external atmosphere via the first and second pluralities of holes.

15. The diffuser according to claim 1 wherein the body comprises a single-piece structure extending from the tailpipe connection interface at the first end to the at least one surface that forms an enclosed second end.

16. A diffuser for a vehicle exhaust system comprising:

a body that extends from a first end to a second end, the body including a tubular portion defined by an outer peripheral wall extending about a central axis and at least one surface that extends at an oblique angle relative to the central axis to form at least one tapered surface;

a tailpipe connection interface formed at the first end of the body for attachment to a tailpipe through which exhaust gas exits to external atmosphere, and with the at least one surface enclosing the second end of the body, and wherein the at least one surface comprises a distal end of the diffuser and wherein the tailpipe terminates at the at least one surface; and a plurality of holes formed within the at least one surface of the body such that the at least one tapered surface extends outwardly of the tailpipe.

17. The diffuser according to claim 16 wherein the plurality of holes comprises a first plurality of holes formed within the at least one surface, and including a second plurality of holes formed within the outer peripheral wall, and wherein the second plurality of holes are defined by a second diameter and the first plurality of holes are defined by a first diameter that is less than the second diameter.

18. The diffuser according to claim 17 wherein the at least one surface comprises at least a first surface extending at a first oblique angle relative to the central axis and a second surface extending at a second oblique angle relative to the central axis.

19. The diffuser according to claim 18 wherein the first surface is on one side of the body and the second surface is on an opposite side of the body, and wherein a rounded end face connects the first surface to the second surface.

20. The diffuser according to claim 16 wherein the plurality of holes comprises a first plurality of holes formed within the at least one surface, and including a second plurality of holes formed within the outer peripheral wall, and wherein exhaust gas exits directly to the external atmosphere via the first and second pluralities of holes.

21. The diffuser according to claim 16 wherein the body comprises a single-piece structure extending from the tailpipe connection interface at the first end to the at least one surface that forms an enclosed second end.

22. A diffuser for a vehicle exhaust system comprising:

a body including a tubular portion defined by an outer peripheral wall extending about a central axis and at least one surface that extends at an angle relative to the central axis, and wherein the body extends from a first end to a second end;

a tailpipe connection interface formed at the first end of the hod that is adapted for attachment to a tailpipe through which exhaust gas exits to external atmosphere, and with the at least one surface extending outwardly and away from the tailpipe to enclose the second end of the body;

a first plurality of holes formed within the outer peripheral wall;

a second plurality of holes formed within the at least one surface;

wherein the body is defined by an outer surface area and wherein the first and second pluralities of holes define a total open area portion of the outer surface area that is at least 50%; and wherein a first open area provided by the first plurality of holes comprises approximately 40% of the total open area and a second open area provided by the second plurality of holes comprises approximately 60% of the total open area greater than tailpipe connection interface diameter.

23. A diffuser for a vehicle exhaust system comprising:

a body including a tubular portion defined by an outer peripheral wall extending about a central axis and at least one surface that extends at an angle relative to the central axis, and wherein the body extends from a first end to a second end;

a tailpipe connection interface formed at the first end of the body that is adapted for attachment to a tailpipe through which exhaust gas exits to external atmosphere, and with the at east one surface extending outwardly and away from the tailpipe to enclose the second end of the body;

a first plurality of holes formed within the outer peripheral wall;

a second plurality of holes formed within the at least one surface;

wherein the at least one surface comprises at least a first surface extending at a first angle relative to the central axis and a second surface extending at a second angle relative to the central axis to form respective first and second tapered faces that taper outwardly away from and external to the tailpipe;

wherein the first and second angles comprise oblique angles;

wherein the first surface is on one side of the body and the second surface is on an opposite side of the body;

wherein the second plurality of holes are formed within the first and second surfaces and are defined by a first hole diameter and the first plurality of holes are defined by a second diameter that is different than the first diameter; and wherein the first diameter is greater than the second diameter.

24. A diffuser for a vehicle exhaust system comprising:

a body including a tubular portion defined by an outer peripheral wall extending about a central axis and at least one surface that extends at an angle relative to the central axis, and wherein the body extends from a first end to a second end;

a tailpipe connection interface formed at the first end of the body that is adapted for attachment to a tailpipe through which exhaust gas exits to external atmosphere, and with the at least one surface extending outwardly and away from the tailpipe to enclose the second end of the body;

a first plurality of holes formed within the outer peripheral wall;

a second plurality of holes formed within the at least one surface wherein the at least one surface comprises at least a first surface extending at a first angle relative to the central axis and a second surface extending at a second angle relative to the central axis to form respective first and second tapered faces that taper outwardly away from and external to the tailpipe;

wherein the first and second angles comprise oblique angles;

wherein the first surface is on one side of the body and the second surface is on an opposite side of the body;

wherein the second plurality of holes are formed within the first and second surfaces and are defined by a first hole diameter and the first plurality of holes are defined by a second diameter that is different than the first diameter;

wherein the body is defined by an outer surface area and wherein the first and second pluralities of holes define a total open area portion of the outer surface area that is within a range of 54% to 80%; and wherein a first open area provided by the first plurality of holes comprises approximately 40% of the total open area and a second open area provided by the second plurality of holes comprises approximately 60% of the total open area.

25. A diffuser for a vehicle exhaust system comprising:

a body that extends from a first end to a second end, the body including a tubular portion defined by an outer peripheral wall extending about a central axis and at least one surface that extends at an oblique angle relative to the central axis to form at least one tapered surface;

a tailpipe connection interface formed at the first end of the body for attachment to a tailpipe through which exhaust gas exits to external atmosphere, and with the at least one surface enclosing the second end of the body;

a plurality of holes formed within the at least one surface of the body such that the at least one tapered surface extends outwardly of the tailpipe;

wherein the plurality of holes comprises a first plurality of holes formed within the at least one surface, and including a second plurality of holes formed within the outer peripheral wall, and wherein the second plurality of holes are defined by a second diameter and the first plurality of holes are defined by a first diameter that is less than the second diameter;

wherein the at least one surface comprises at least a first surface extending at a first oblique angle relative to the central axis and a second surface extending at a second oblique angle relative to the central axis; and wherein the at least one tapered surface extends to a distal edge at the second end that is spaced a greater axial distance from the tailpipe than an opposite edge of the at least one tapered surface.

26. A diffuser for a vehicle exhaust system comprising:

a body that extends from a first end to a second end, the body including a tubular portion defined by an outer peripheral wall extending about a central axis and at least one surface that extends at an oblique angle relative to the central axis to form at least one tapered surface;

a tailpipe connection interface formed at the first end of the body for attachment to a tailpipe through which exhaust gas exits to external atmosphere, and with the at east one surface enclosing the second end of the body;

a plurality of holes formed within the at least one surface of the body such that the at least one tapered surface extends outwardly of the tailpipe;

wherein the plurality of holes comprises a first plurality of holes formed within the at least one surface, and including a second plurality of holes formed within the outer peripheral wall, and wherein the second plurality of holes are defined by a second diameter and the first plurality of holes are defined by a first diameter that is less than the second diameter;

wherein the at least one surface comprises at least a first surface extending at a first oblique angle relative to the central axis and a second surface extending at a second oblique angle relative to the central axis; and wherein the first and second surfaces extend to a further axial extent on one side of the tubular portion than on an opposite side of the tubular portion.

27. A diffuser for a vehicle exhaust system comprising:

a body including a tubular portion defined by an outer peripheral wall extending about a central axis and at least one surface that extends at an angle relative to the central axis, and wherein the body extends from a first end to a second end;

a tailpipe connection interface formed at the first end of the body that is adapted for attachment to a tailpipe through which exhaust gas exits to external atmosphere, and with the at least one surface extending outwardly and away from the tailpipe to enclose the second end of the body;

wherein the angle of the at least one surface comprises an oblique angle such that the surface comprises a tapered end face that tapers outwardly away from and external to the tailpipe, and with the outer peripheral wall extending in an axial direction from an outer peripheral edge of the tapered end face to the tailpipe connection interface;

wherein the at least one tapered end face extends to a distal edge at the second end that is spaced a greater axial distance from the tailpipe than an opposite edge of the at least one tapered end face;

a first plurality of holes formed within the outer peripheral wall; and a second plurality of holes formed within the at least one surface.

28. A diffuser for a vehicle exhaust system comprising:

a body including a tubular portion defined by an outer peripheral wall extending about a central axis and at least one surface that extends at an angle relative to the central axis, and wherein the body extends from a first end to a second end;

a tailpipe connection interface formed at the first end of the body that is adapted for attachment to a tailpipe through which exhaust gas exits to external atmosphere, and with the at least one surface extending outwardly and away from the tailpipe to enclose the second end of the body;

a first plurality of holes formed within the outer peripheral wall:

a second plurality of holes formed within the at least one surface;

wherein the at least one surface comprises at least a first surface extending at a first angle relative to the central axis and a second surface extending at a second angle relative to the central axis to form respective first and second tapered faces that taper outwardly away from and external to the tailpipe; and wherein the first and second tapered faces extend to a further axial extent on one side of the tubular portion than on an opposite side of the tubular portion.

* * * * *

UNITED STATES PATENT AND TRADEMARK OFFICE

CERTIFICATE OF CORRECTION

PATENT NO. : 9,121,329 B2
APPLICATION NO. : 13/454123
DATED : September 1, 2015
INVENTOR(S) : Joseph Trent Bogard et al.

It is certified that error appears in the above-identified patent and that said Letters Patent is hereby corrected as shown below:

IN THE CLAIMS:

In claim 22, column 6, line 35; delete “hod” and replace with --body--

In claim 23, column 6, line 62; delete “east” and replace with --least--

In claim 26, column 8, line 28; delete “east” and replace with --least--

Signed and Sealed this
Twelfth Day of January, 2016

Michelle K. Lee

Michelle K. Lee
*Director of the United States Patent and Trademark Office*